US011591780B2

(12) United States Patent
Chen et al.

(10) Patent No.: US 11,591,780 B2
(45) Date of Patent: Feb. 28, 2023

(54) FAUCET AERATOR

(71) Applicant: YEUU DENG SANITARY FACILITIES INDUSTRIAL CO., LTD., Chang Hua Hsien (TW)

(72) Inventors: Wen-Pin Chen, Chang Hua Hsien (TW); Kai-Chi Chen, Chang Hua Hsien (TW)

(73) Assignee: YEUU DENG SANITARY FACILITIES INDUSTRIAL CO., LTD., Chang Hua Hsien (TW)

( * ) Notice: Subject to any disclaimer, the term of this patent is extended or adjusted under 35 U.S.C. 154(b) by 364 days.

(21) Appl. No.: 16/849,122

(22) Filed: Apr. 15, 2020

(65) Prior Publication Data

US 2021/0324616 A1 Oct. 21, 2021

(51) Int. Cl.
*E03C 1/084* (2006.01)
*E03C 1/04* (2006.01)

(52) U.S. Cl.
CPC ..... *E03C 1/084* (2013.01); *E03C 1/0404* (2013.01)

(58) Field of Classification Search
CPC ..... E03C 1/084; E03C 1/0404
See application file for complete search history.

(56) References Cited

U.S. PATENT DOCUMENTS 3,635,405 A * 1/1972 Shames ..... E03C 1/084 239/428.5
3,684,191 A * 8/1972 Shames ..... E03C 1/084 239/DIG. 19
5,467,929 A * 11/1995 Bosio ..... B01F 23/234 239/428.5
6,126,093 A * 10/2000 Grether ..... E03C 1/08 239/553.5
11,319,697 B2 * 5/2022 Gong ..... B05B 7/0425
11,434,629 B2 * 9/2022 Tempel ..... E03C 1/08
11,441,298 B2 * 9/2022 Stein ..... E03C 1/084
2002/0084353 A1 * 7/2002 Griffin ..... E03C 1/084 239/590.5
2003/0141384 A1 * 7/2003 Grether ..... E03C 1/084 239/428.5
2003/0146302 A1 * 8/2003 Dieterle ..... B29C 45/1676 239/428.5
2006/0011748 A1 * 1/2006 Ferrari ..... E03C 1/08 239/398
2006/0273203 A1 * 12/2006 Denzler ..... E03C 1/04 239/553.3
2006/0283511 A1 * 12/2006 Nelson ..... E03C 1/0404 137/801

(Continued)

*Primary Examiner* — Craig M Schneider
*Assistant Examiner* — Frederick D Soski

(57) ABSTRACT

A faucet aerator comprises: a casing and a guiding member. The casing has a water inlet 11 and a water outlet. The water inlet is provided with a threaded portion for engaging with a faucet. The casing is further provided with at least one ring groove at an inner surface for engaging with the guiding member. The guiding member has a barrel body with a pre-filter, and the pre-filter is provided with at least one ring rib for engaging with the ring groove when the guiding member is placed in the casing, to avoid the guiding member from escaping the casing while the aerator is cleaned. The barrel body provided with a plurality of through apertures, a bottom mesh, and a first aerating mesh.

1 Claim, 5 Drawing Sheets

(56) References Cited

U.S. PATENT DOCUMENTS

2008/0169361 A1* 7/2008 Lacher ..... E03C 1/084 239/428.5
2008/0185060 A1* 8/2008 Nelson ..... B05B 15/65 285/8
2008/0251604 A1* 10/2008 Schmid ..... E03C 1/084 239/113
2009/0224067 A1* 9/2009 Grether ..... E03C 1/084 239/106
2010/0025499 A1* 2/2010 Zoller ..... E03C 1/084 239/570
2010/0065661 A1* 3/2010 Grether ..... E03C 1/084 239/428.5
2010/0071778 A1* 3/2010 Nelson ..... E03C 1/0404 137/15.01
2011/0006132 A1* 1/2011 Grether ..... E03C 1/084 239/428.5
2011/0240900 A1* 10/2011 Gordon ..... E03C 1/0412 251/339
2012/0103451 A1* 5/2012 Lin ..... F16L 55/02718 137/833
2013/0008980 A1* 1/2013 Grether ..... E03C 1/08 239/428.5
2013/0032231 A1* 2/2013 Stein ..... B05B 1/3026 137/561 R
2013/0049235 A1* 2/2013 Lin ..... E03C 1/084 261/114.1
2013/0068860 A1* 3/2013 Tempel ..... B05B 12/002 239/428.5
2013/0082122 A1* 4/2013 Stein ..... E03C 1/086 239/428.5
2013/0082123 A1* 4/2013 Stein ..... E03C 1/084 239/428.5
2013/0134235 A1* 5/2013 Blum ..... B05B 1/3402 239/428.5
2013/0134239 A1* 5/2013 Blum ..... B05B 1/14 239/600
2013/0175366 A1* 7/2013 Zoller ..... E03C 1/084 239/428.5
2013/0248005 A1* 9/2013 Pitsch ..... E03C 1/04 137/315.12
2013/0283522 A1* 10/2013 Novak ..... A61H 35/02 4/678
2014/0203107 A1* 7/2014 Lacher ..... E03C 1/084 137/487
2014/0217203 A1* 8/2014 Zoller ..... E03C 1/084 239/428.5
2014/0300010 A1* 10/2014 Zhou ..... E03C 1/084 261/78.2
2015/0102133 A1* 4/2015 Tempel ..... E03C 1/084 239/428.5
2015/0204058 A1* 7/2015 Grether ..... E03C 1/084 239/428.5
2016/0002897 A1* 1/2016 Tempel ..... G05D 7/012 239/428.5
2016/0017580 A1* 1/2016 Blum ..... E03C 1/086 239/428.5
2016/0024769 A1* 1/2016 Zoller ..... E03C 1/084 239/407
2016/0177553 A1* 6/2016 Bosio ..... E03C 1/086 239/428.5
2016/0222638 A1* 8/2016 Stein ..... E03C 1/084
2016/0222639 A1* 8/2016 Stein ..... G05D 7/012
2016/0265202 A1* 9/2016 Blum ..... E03C 1/086
2017/0101768 A1* 4/2017 Bosio ..... E03C 1/084
2017/0136476 A1* 5/2017 Wu ..... B05B 15/40
2017/0138026 A1* 5/2017 Huang ..... E03C 1/084
2017/0185090 A1* 6/2017 Twitchett ..... G05D 7/012
2017/0298600 A1* 10/2017 Rosko ..... E03C 1/084
2018/0038085 A1* 2/2018 Birmelin ..... E03C 1/084
2018/0087247 A1* 3/2018 Blum ..... E03C 1/084
2018/0148913 A1* 5/2018 Birmelin ..... E03C 1/084
2018/0274214 A1* 9/2018 Rosko ..... E03C 1/0401
2019/0194918 A1* 6/2019 Schurle ..... E03C 1/084
2019/0234056 A1* 8/2019 Willmann ..... E03C 1/084
2019/0301148 A1* 10/2019 Schurle ..... B05B 1/30
2019/0368176 A1* 12/2019 Li ..... E03C 1/084
2019/0376265 A1* 12/2019 Huang ..... B05B 1/169
2020/0199857 A1* 6/2020 Stein ..... E03C 1/084
2020/0206761 A1* 7/2020 Fan ..... B05B 7/0425
2020/0224395 A1* 7/2020 Stein ..... E03C 1/084
2020/0318329 A1* 10/2020 Tempel ..... E03C 1/084
2021/0277639 A1* 9/2021 Birmelin ..... E03C 1/086
2021/0285194 A1* 9/2021 Stein ..... E03C 1/084
2021/0388586 A1* 12/2021 Stein ..... E03C 1/084
2022/0154438 A1* 5/2022 Lacher ..... E03C 1/084
2022/0170249 A1* 6/2022 Schürle ..... E03C 1/084
2022/0178120 A1* 6/2022 Schürle ..... E03C 1/084
2022/0213977 A1* 7/2022 Kao ..... E03C 1/0404

* cited by examiner

FAUCET AERATOR

BACKGROUND OF INVENTION

Field of Invention

The present invention relates to a faucet aerator, and more particularly to a faucet aerator capable of saving water.

Description of the Related Art

Currently, the aerator is installed at a faucet outlet, and the aerator is mainly used to introduce air to break the water flow, so that the output water contains a large number of bubbles. When the water containing a large number of fine bubbles flows out, it provides an illusion of large flow, so as to achieve the purpose of saving water.

The conventional aerator 50, as shown in FIG. 5, includes: a casing 51 and a guiding member 52. The casing 51 has a water inlet 511 and a water outlet 512, and the water inlet is provided with a threaded portion 513 for being screwed on the faucet outlet. In addition, the inner wall of the casing 51 is provided with a flange 514, when the guiding member 52 is placed in the casing 51 the flange 514 supports the guiding member 52, which can prevent the guiding member 52 from falling out of the water outlet 512 after being inserted. Furthermore, a filter 521 is installed on the guiding member 52 configured to filter water before flowing into the guiding member 52.

However, the above-mentioned conventional structure still has the following problems in practical application: The filter 521 of the aerator 50 collects foreign substances such as impurities, fine sand, and scale during use, the aerator 50 needs to be removed and cleaned regularly to keep the water flowing out smoothly; however, there is no anti-detachment design between the casing 51 and the guiding member 52, the aerator 50 can be easily removed and cleaned by fingers or the aerator 50 needs to be inverted which causes the entire guiding member 52 to fall out of the water inlet 511 of the casing 51, and the guiding member 52 and the casing 51 need to be re-installed. If the re-assembly is careless, the guiding member 52 may be missing.

Therefore, it is desirable to provide a faucet aerator capable to mitigate and/or obviate the aforementioned problems.

SUMMARY OF THE INVENTION

An objective of present invention is to provide a faucet aerator, which is capable of improving the above-mention problems.

In order to achieve the above mentioned objective, a faucet aerator has: a casing and a guiding member. The casing has a water inlet 11 and a water outlet. The water inlet is provided with a threaded portion for engaging with a faucet. The casing is further provided with at least one ring groove at an inner surface for engaging with the guiding member. The guiding member has a barrel body with a pre-filter, and the pre-filter is provided with at least one ring rib for engaging with the ring groove when the guiding member is placed in the casing, to avoid the guiding member from escaping the casing while the aerator is cleaned. The barrel body provided with a plurality of through apertures, a bottom mesh, and a first aerating mesh.

Other objects, advantages, and novel features of invention will become more apparent from the following detailed description when taken in conjunction with the a the guiding member Companying drawings.

DETAILED DESCRIPTION OF THE PREFERRED EMBODIMENT

Figure 1:
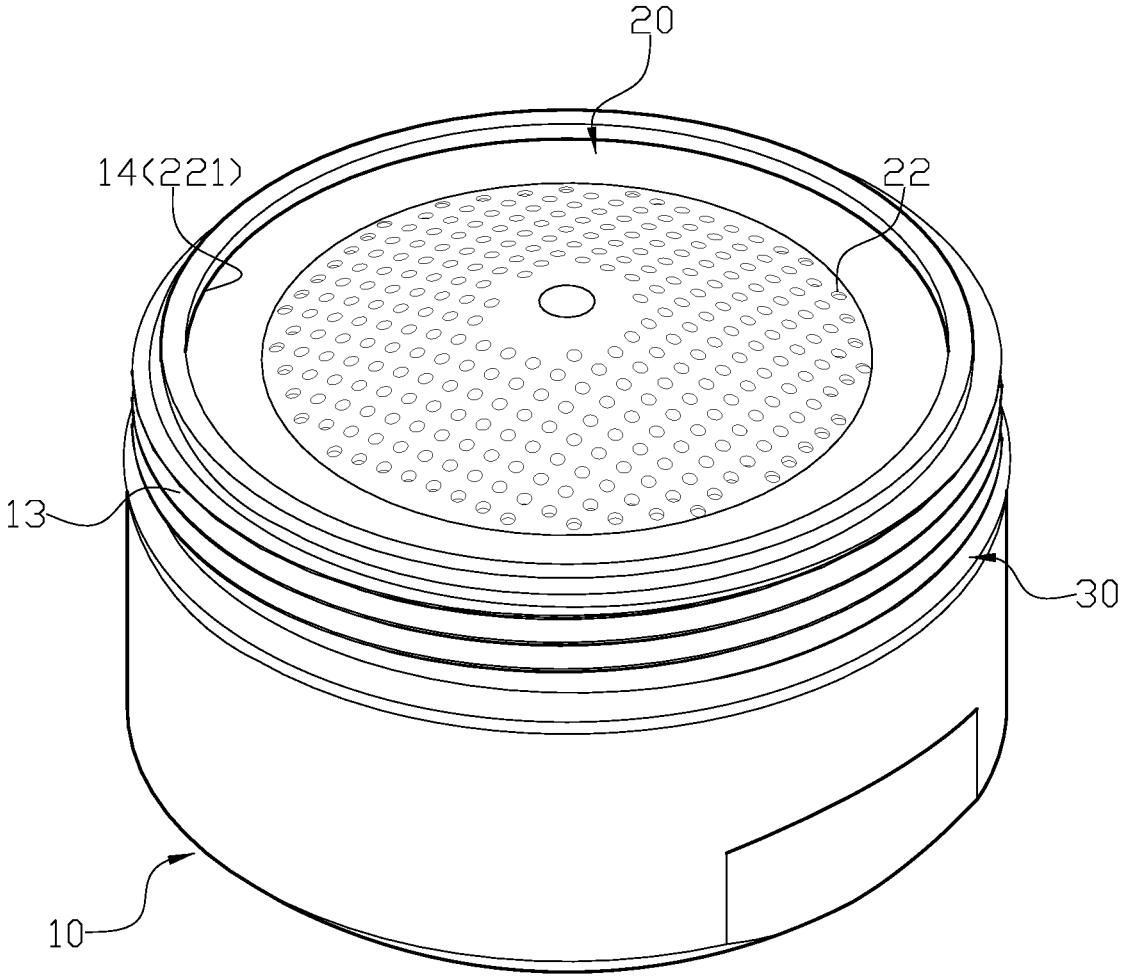
FIG. 1 is a three-dimensional combination drawing of a preferred embodiment according to the present invention.
Figure 2:
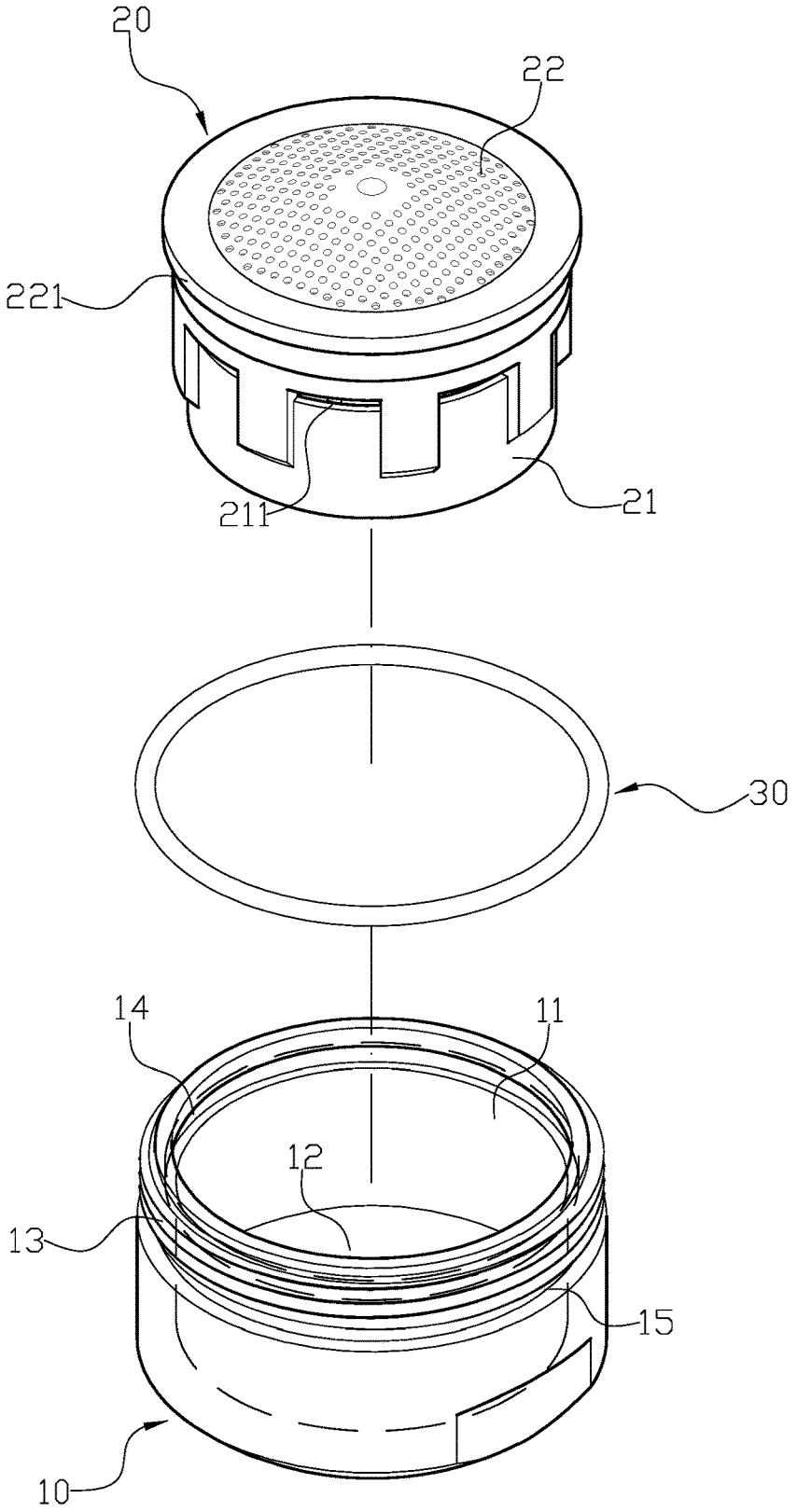
FIG. 2 is a three-dimensional exploded view of the preferred embodiment according to the present invention.
Figure 3:
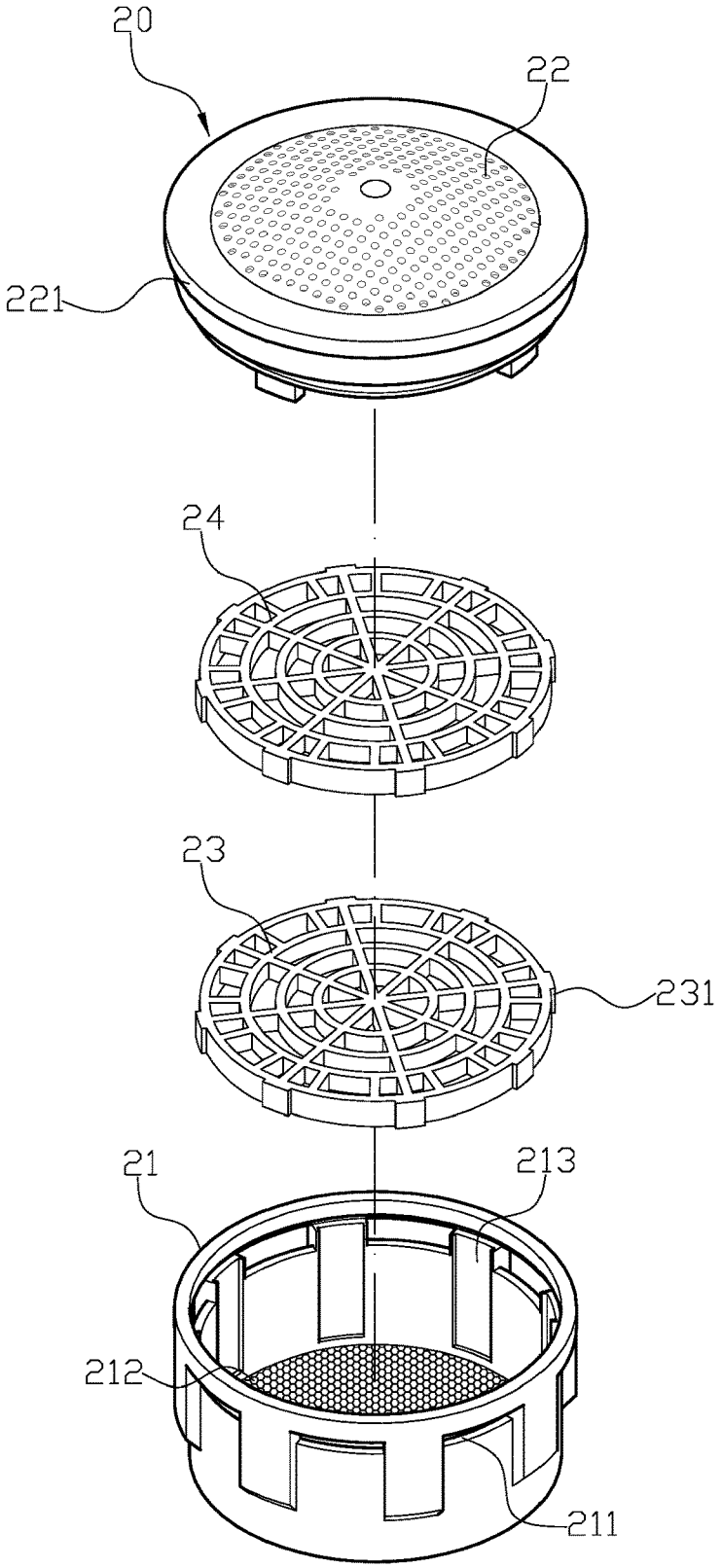
FIG. 3 is a detailed illustration of the guiding member of the preferred embodiment according to the present invention.
Figure 4:
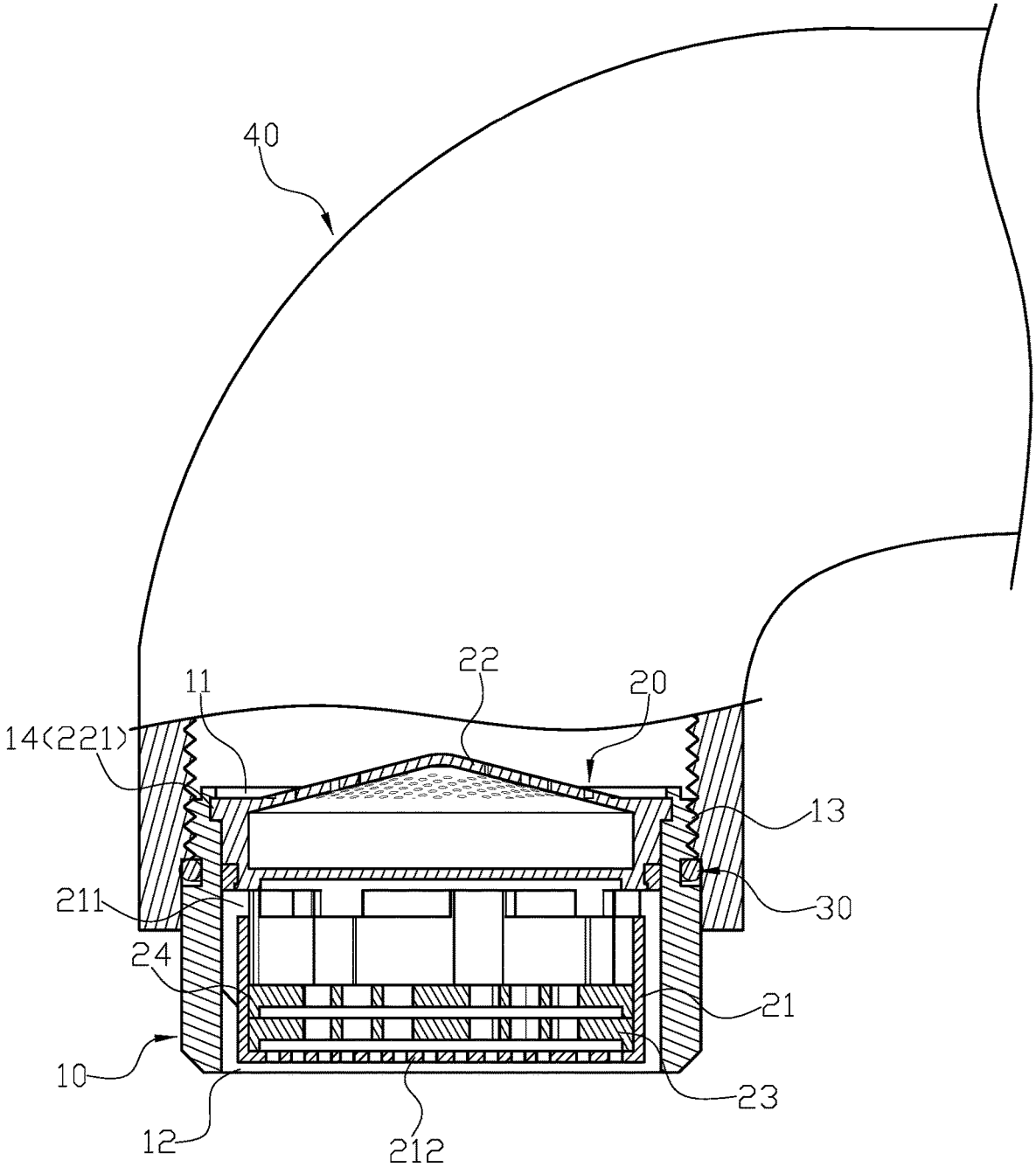
FIG. 4 is a usage drawing of the faucet aerator installed on a faucet outlet according to the present invention.
Figure 5:
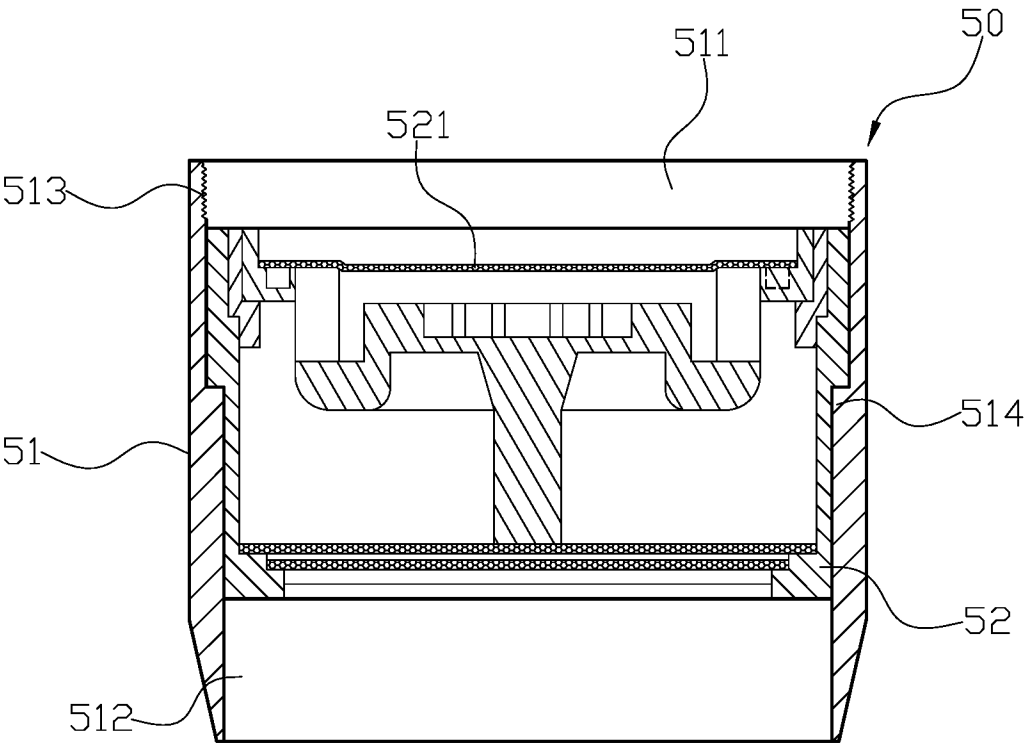
FIG. 5 PRIOR ART
FIG. 5 is a conventional structure diagram.

Please refer to FIG. 1 to FIG. 4. A faucet aerator comprises: a casing 10 and a guiding member 20. The casing 10 has a water inlet 11 and a water outlet 12. The water inlet 11 is provided with a threaded portion 13 for engaging with a faucet 40. The casing 10 is further provided with at least one ring groove 14 at an inner surface for engaging with the guiding member 20. The guiding member 20 has a barrel body 21 with a pre-filter 22, and the pre-filter 22 is provided with at least one ring rib 221 for engaging with the ring groove 14 when the guiding member 20 is placed in the casing 20, to avoid the guiding member 20 from escaping the casing 10 while the aerator is cleaned. The barrel body 21 provided with a plurality of through apertures, a bottom mesh 212, and a first aerating mesh 23.

Furthermore, the casing 10 is made from a copper ingot.

Furthermore, the ring groove 14 is disposed on the casing 10 adjacent to the water inlet 11.

Moreover, the threaded portion 13 is an outer threaded section.

In addition, the threaded portion 13 of the casing 10 is provided with an engaging ring groove 15, and a sealing ring 30 is jacketed on the engaging groove 15 to leakage between the faucet 40 and the casing 10.

In addition, the barrel body 21 has a bottom with honeycomb holes 212.

Additionally, the barrel body 21 further comprises a plurality of guiding slots 213 at the inner surface and extending beyond the through apertures 211, the first aerating mesh 23 further comprises a plurality of guiding members 231 at an outer periphery, and the guiding members 231 engage with the guiding slots 213 for securing the first aerating mesh 23 in the barrel body 21.

Also, wherein the barrel body 21 further comprises a plurality of guiding slots 213 on the inner surface and extending beyond the through apertures 211, the first aerating mesh 23 further comprises a plurality of guiding members 231 at an outer periphery, and the guiding members 231 engage with the guiding slots 213 for securing the first aerating mesh 23 in the barrel body 21, and the first aerating mesh 23 is equipped with a second aerating mesh 24.

Correspondingly, the ring groove 14 a guiding portion is disposed above the ring groove 14 for guiding the ring rib 221 into engagement with the ring groove 14.

In actual use, water from the faucet 40 enters into the water inlet 11 of the aerator and uses the aerator to introduce air to break the water flow. When the water outlet 12 outputs a large amount of fine water, the flow rate feels larger than it actually is. With the engagement between the ring groove

14 and the ring rib 221, when the aerator is dismantled and cleaned by the finger or being overturned, the guiding member 20 is still mounted in the casing. Therefore, the use of the aerator is convenient.

Although the present invention has been explained in relation to its preferred embodiment, it is to be understood that many other possible modifications and variations can be made without departing from the spirit and scope of invention as hereinafter claimed.

What is claimed is:

1. A faucet aerator consisting of:

a casing, a sealing ring, a prefilter, a first aerating mesh, a second aerating mesh, and a barrel body;

wherein the casing is made of copper and further monolithically forms:

threads on an outer surface of the casing positioned adjacent an upstream end of the casing;

a ring groove formed in a sidewall of an inner surface of the casing;

a sealing ring groove formed on the outer surface of the casing positioned between the threads and a downstream end of the casing; and wherein the prefilter further monolithically forms:

a first outer diameter portion, a second outer diameter portion, and a third outer diameter portion having respectively a first radial diameter, a second radial diameter, and a third radial diameter, wherein the second radial diameter is smaller than the first radial diameter and larger than the third radial diameter;

a central void at least partially formed by the first, second, and third outer diameter portions;

an annular ring rib formed at the first outer diameter portion;

an annular ring;

a frusto-conical portion which points upstream and forms an upstream sidewall of the central void; and wherein the barrel body further monolithically forms:

a bottom having honeycomb holes;

a plurality of through apertures;

a plurality of guiding slots formed on an inner surface of the barrel body and positioned circumferentially between the plurality of through apertures; and wherein the first aerating mesh further monolithically forms:

a first plurality of guiding members; and wherein the second aerating mesh further monolithically forms:

a second plurality of guiding members; and wherein the sealing ring is positioned within the sealing ring groove of the casing; and wherein the annular ring rib of the prefilter is positioned within the ring groove of the casing; and wherein the annular ring is positioned between the third outer diameter portion of the prefilter and an inner surface of the casing; and wherein the first plurality of guiding members of the first aerating mesh are positioned within the plurality of slots of the barrel body; and wherein the second plurality of guiding members of the second aerating mesh are positioned within the plurality of slots of the barrel body; and wherein the barrel body is directly attached to a downstream end of the prefilter.

* * * * *